US005287692A

United States Patent [19]

Matsubayashi

[11] Patent Number: 5,287,692

[45] Date of Patent: Feb. 22, 1994

[54] TRANSPORT MEDIUM FOR YARN OR THE LIKE

[75] Inventor: Junichi Matsubayashi, Toyonaka, Japan

[73] Assignee: Murata Kikai Kabushiki Kaisha, Kyoto, Japan

[21] Appl. No.: 556,551

[22] Filed: Jul. 20, 1990

[30] Foreign Application Priority Data

Jul. 26, 1989 [JP] Japan ..... 1-194735

[51] Int. Cl.[5] ..... D01H 9/10; D01H 9/00

[52] U.S. Cl. ..... 57/281; 57/90; 57/264; 57/265; 242/35.5 A

[58] Field of Search ..... 57/90, 281, 264–265; 242/35.5 A

[56] References Cited

U.S. PATENT DOCUMENTS

| | | | |
|---|---|---|---|
| 4,660,370 | 4/1987 | Matsui et al. | 242/35.5 A |
| 4,681,231 | 7/1987 | Ueda et al. | 242/35.5 A |
| 4,694,949 | 8/1987 | Nakagawa | 242/35.5 A |
| 4,703,651 | 11/1987 | Mima | 73/160 |
| 4,720,967 | 1/1988 | Guttler | 57/281 |
| 4,838,019 | 6/1989 | Ueda | 57/281 X |

*Primary Examiner*—John M. Jillions
*Assistant Examiner*—William Stryjewski
*Attorney, Agent, or Firm*—Spensley Horn Jubas & Lubitz

[57] ABSTRACT

In a transport medium for yarn or the like which comprises a medium for transporting directly or indirectly a yarn or the like, such as a tray for fitting upright a bobbin thereon, and media capable of writing therein and reading therefrom of various information on the yarn, the media attached to the transporting medium.

19 Claims, 3 Drawing Sheets

19

| SPINDLE NO. | NI | S | L | T | CV | YARN STRENGTH | RESIDUAL DEFECTS | |
|---|---|---|---|---|---|---|---|---|
| 1 | | | | | | | | |
| 2 | | | | | | | | |
| 3 | | | | | | | | |
| 4 | | | | | | | | |
| 5 | | | | | | | | |
| ⋮ | | | | | | | | |

TRANSPORT MEDIUM FOR YARN OR THE LIKE

FIELD OF THE INVENTION

The invention relates to a transport medium for yarn or the like and more particularly relates to a transport medium for transporting bobbins between steps for processing yarns.

RELATED ART STATEMENT

A process for producing a yarn includes a variety of steps. For instance, a cotton yarn is produced through a mixing and blowing step, a carding step, a drawing step, a roving step, a fine spinning step, a rewinding step, etc. Further, the yarn is fed through a doubling step, a twisting step and a dyeing step to a warper for warp or for weft in a weaving machine, or to a knitting machine.

When a defective yarn is produced in one of the above-mentioned steps, there is a high possibility that the defective yarn may be found in one of the subsequent steps. Even if the defective yarn is found, it is extremely difficult to trace the origin of the defective yarn.

Therefore, it is possible to clear up the cause of the defect if it is possible to recognize the production spindle in the previous step on which a yarn appearing in the subsequent step has been produced.

OBJECT AND SUMMARY OF THE INVENTION

In consideration of the above-mentioned points, it is an object of an embodiment of this invention to provide a transport medium for yarn or the like which enables spindle control between steps for producing yarns.

In accordance with one embodiment of the present invention, a transport medium for yarn comprises a medium for transporting directly or indirectly material such as a yarn and media capable of writing therein and reading therefrom of various information on the yarn, the media attached to the transporting medium.

DETAILED DESCRIPTION OF PREFERRED EMBODIMENT

Figure 1:
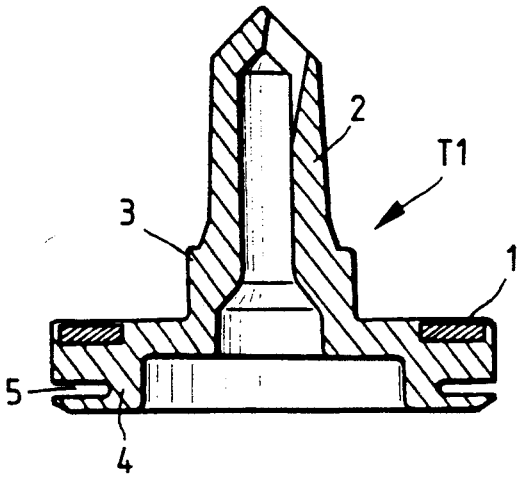
FIG. 1 is a sectional front view of a tray with an ID card embedded therein according to an embodiment of the present invention.

Some embodiments of this invention will now be explained below referring to the drawings.

FIGS. 1 to 4 each show a transport medium (hereinafter referred to as tray T1) to which an ID card 1 capable of writing therein and reading therefrom of information is attached.

Figure 2:
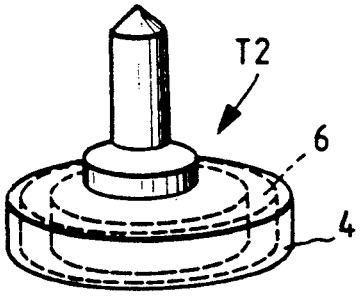
FIG. 2 is a perspective view showing one embodiment of the same.

Referring to FIG. 1, the tray T1 is integrally molded from a resin or the like, and comprises a peg 2 for fitting a spinning bobbin upright thereon, a support portion 3 for supporting the lower end of the bobbin, and a base 4 to be placed on a conveyor, with an annular ID card (identification card) 1 embedded in a portion of the base 4. Denoted by 5 is an identification groove for the bobbin fitted upright on the tray, provided for transportation through identification of bobbins at a branch point of passage. FIG. 2 also shows a tray T2 in which a cylindrical ID card 6 is firmly embedded in a base 4 of the tray.

Figure 3:
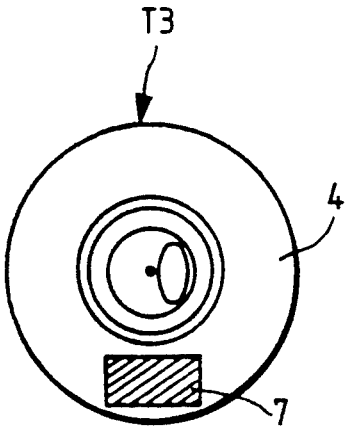
FIG. 3 is a plan view showing another embodiment of the same.
Figure 4:
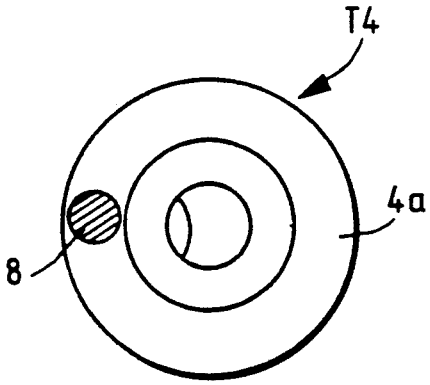
FIG. 4 is a bottom view showing a further embodiment of the same.

FIG. 3 shows a tray T3 in which an ID card 7 is embedded in a portion of the upper surface of a base 4 of the tray, and FIG. 4 shows a tray T4 in which a disk-shaped ID card 8 is embedded in a lower surface 4*a* of a base of the tray.

Where the ID card 1, 6 is embedded in the base 4, as in FIGS. 1 and 2, the ID card is not exposed to the outside of the tray, so that the ID card will not be damaged and is capable of being protected from troubles during transportation.

In the above-mentioned ID card, a memory with an arbitrary capacity, for instance, 100 bytes to 1 K bytes, can be mounted, and various information or data on a yarn can be written therein.

Therefore, the quantity of data recordable in the ID card is much greater than those in the case of bar code, magnet, etc., it is possible to provide a data-checking function, and the reliability of data is high.

As the ID card, cards of various types are applicable, for instance, a type in which a battery-incorporating type automatic recognition device utilizing radio wave, light or the like is embedded in the card, or a type in which a read-write memory utilizing radio wave, light or the like is embedded in a card. In the type which utilizes radio wave, it is possible to carry out reading and writing of information or data through radiocommunication while the tray is moved, within the range of the antenna used.

One example of a bobbin conveying system employing trays each provided with the above-mentioned ID card will be shown as follows.

Figure 5:
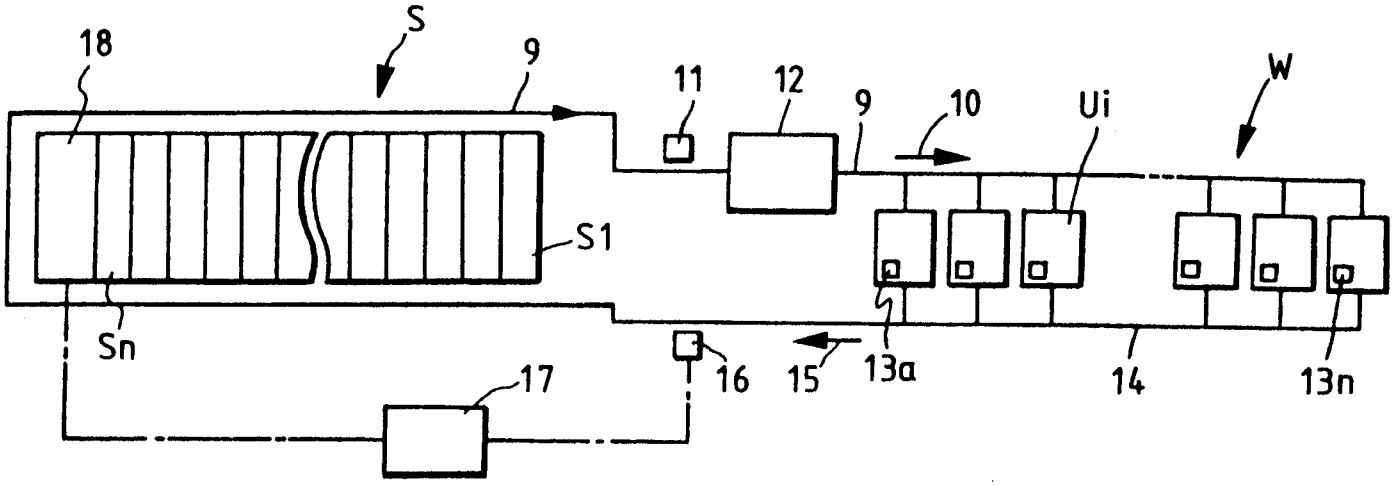
FIG. 5 is a layout plan showing a bobbin conveying system for a spinning winder to which the tray of FIG. 1 is applied.
Figure 6:
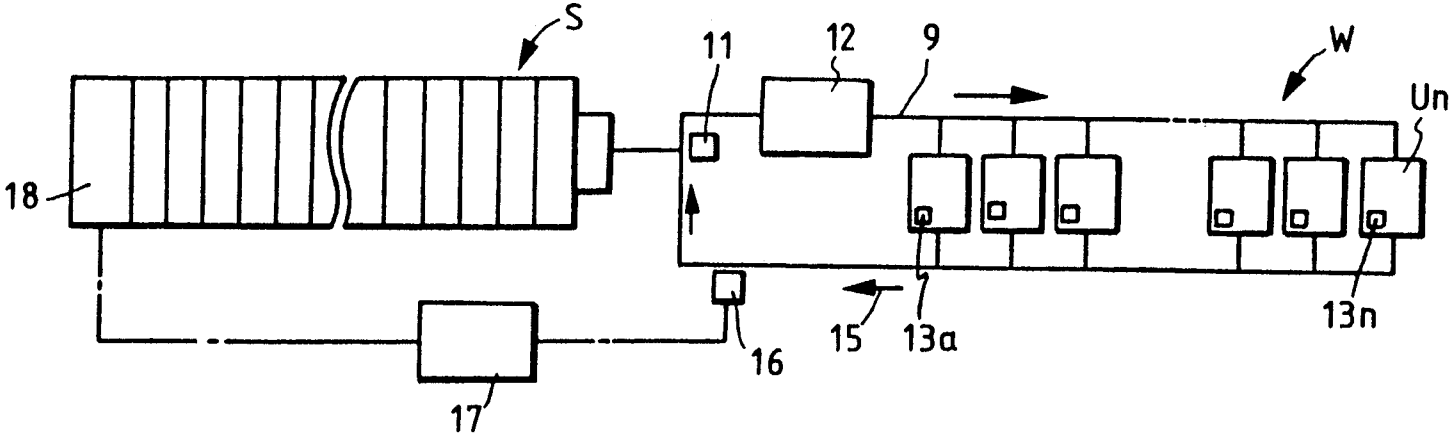
FIG. 6 is another layout plan for the system.

FIGS. 5 and 6 each illustrates an application to a bobbin conveying system between a spinning frame S and an automatic winder W.

The system shown in FIG. 5 is of the type in which the trays shown in FIG. 1 are circularly transported between the spinning frame S and the automatic winder W. For instance, spinning bobbins produced on a multiplicity of spinning spindles Sl to Sn are, after doffed, fitted upright on the trays, one on each tray, and are transported on a conveying line 9 in the direction of arrow 10. Each time a tray reaches the position of a writing device 11 provided midway of the conveying line, the spindle number of the spinning spindle on which the bobbin on the tray has been produced is recorded into the tray.

Figures 7, 8:
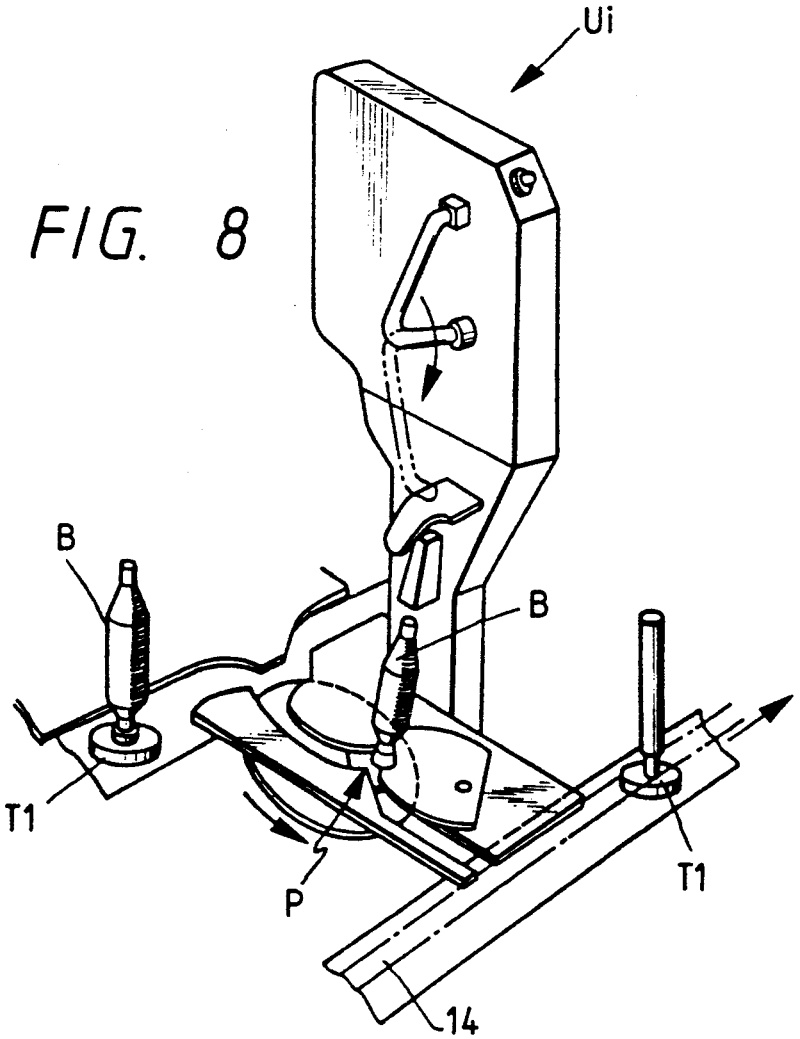
FIG. 7 is a typical diagram showing one example of computer-controlled data.
FIG. 8 is a perspective view showing one example of a winding unit applied to the winder in FIGS. 5 and 6.

Then, the tray and the bobbin, in one body, are supplied through a yarn-preparing device 12 to an arbitrary winding unit Ui in the automatic winder, as shown in FIG. 8, and the yarn is rewound from the bobbin B set in a rewinding position P. Each winding unit is provided with a yarn clearer, and, when a defect is found in the yarn being rewound, the yarn is cut and automatic yarn joining (or splicing) is carried out. In such a case, the kind of defect due to which the yarn is cut is stored in each unit. For instance, the number of yarn breakages S due to slub, the number of yarn cuttings L due to a defect of a length not less than a preset length, the number of yarn cuttings T due to a yarn finer than a preset fineness, and, further, the evenness CV of yarn, the yarn strength measured by a yarn strength measuring instrument [for instance, the instrument disclosed in Japanese Patent Laid-Open (KOKAI) No. 61-146827 (1986)] and the like are also stored in each unit.

When winding for one spinning bobbin is finished, the various clearer data stored as above and the spindle number of the winder are written into the ID card in the tray. The units are provided with writing devices 13*a* to 13*n*, respectively. After the writing of the data, the empty bobbin and the tray, still in one body, are discharged onto a return conveyor 14.

The tray thus discharged is transported on the conveyor in the direction of arrow 15 to reach a data reading position, when a reading device 16 reads the data written in the ID card and transmits the data to a controlling computer 17. Based on the data received through communication, the controlling computer controls a table 19 of yarn clearer data (S, L, T, CV . . . , etc.) in correspondence with the spindle numbers of the spinning frame.

When a spinning spindle with the clearer data having a value beyond a limit value for control is generated, it is possible to stop the fine spinning operation of the spindle by sending a signal from the above computer to a controller 18 disposed on the spinning frame side. Alternatively, the spinning spindle can be provided with an abnormality indication means to indicate the abnormal condition. The computer, by preserving the clearer data over a long time, is able to check the tendency of each spindle in the spinning frame, thereby enabling preventive maintenance. FIG. 6 illustrates a bobbin conveying system of the type in which the trays T1 are circularly moved in the region of the winder and which operates similarly to the above.

The tray with the ID card attached thereto as mentioned above is also applicable to a system in which a plurality of spinning frames are connected to a plurality of winders or a single winder by a common conveying line. In this case, information on the kind of yarn, machine number of spinning frame or the like is additionally recorded in each tray. Therefore, even when a variety of spinning bobbins are transported at random on the single conveying line, it is possible to distribute the bobbins of a specified kind to a specified winder. Recording and reading of clearer data is capable of being carried out in the same manner as in the above embodiment.

Though the ID card has been described as being attached to the tray in the above embodiment, it is also possible, naturally, to attach the ID card to the bobbin itself and to perform writing and reading of various information, such as clearer data, in a manner similar to the above.

Furthermore, it is also possible to provide the ID card directly on a lap for transporting cotton from a mixing and blowing step to a carding step, to attach the IC card to a can between the carding step and a drawing step or between the drawing step and a roving step, to incorporate the ID card in a sliver hanger or sliver bobbin between a fine spinning step and another fine spinning step, or to attach the ID card to a conveying hanger between a winding step and the next step. It is thus possible to recognize and control the information on which spindle on which machine, in the range from the mixing and blowing step to the shipping step or the weaving or knitting step, a given yarn has been produced. It is thereby possible to clear out the cause of the defect in a defective yarn, and to apply the transport medium with the ID card to product kind control in a many-kind small-volume manufacturing system.

As has been described above, in this invention a medium for transporting a yarn is provided with media capable of writing and reading information or data, the media attached directly or indirectly to the transporting medium. The transporting medium with the media according to the invention makes it possible to control spindles between processing steps for production of yarns, based on the information stored in the media moved between the steps, thereby contributing to realization of CIM (Computer Integrated Manufacturing) in a textile mill. Moreover, the transport medium of this invention enables real-time quality control.

What is claimed is:

1. A spinning bobbin control apparatus for use with an automatic winder having a plurality of winding units, the spinning bobbin control apparatus comprising:

a tray for transporting a spinning bobbin, storage means, attached to the tray, for storing yarn information data, the storage means being capable of having the data written therein and read therefrom, and writing means, disposed on each of the plurality of winding units, for writing data into the storage means at each winding unit when winding for a bobbin is finished at each respective winding unit, the data including a representation of at least one of a number of yarn breakage due to slub, a number of yarn cuttings due to a defect of a length not less than a present length, evenness of yarn, and yarn strength.

2. A spinning bobbin control apparatus as claimed in claim 1, wherein the storage means comprises an identification card.

3. A spinning bobbin control apparatus as claimed in claim 2, wherein the tray comprises a peg for fitting a bobbin upright thereon, a support portion for supporting a lower end of the bobbin, and a base to be placed on a conveyor.

4. A spinning bobbin control apparatus as claimed in claim 3, wherein the tray comprises an identification groove for the bobbin fitted upright thereon, provided for identification of bobbins at a branch point of passage on the conveyor.

5. A spinning bobbin control apparatus as claimed in claim 4, wherein an annular identification card is embedded in a portion of the base.

6. A spinning bobbin control apparatus as claimed in claim 4, wherein a cylindrical identification card is embedded in a portion of the base.

7. A spinning bobbin control apparatus as claimed in claim 4, wherein an identification card is embedded in a portion of an upper surface of the base.

8. A spinning bobbin control apparatus as claimed in claim 4, wherein an identification card is embedded in a lower face of the base.

9. A method of storing data in a bobbin transport system used with a spinning frame having a plurality of spindles and an automatic winder having a plurality of winding units, the method comprising the steps of:

providing bobbin support means for supporting a bobbin, the bobbin support means including storage means, disposed on the support means, for storing data which may be written therein and read therefrom, writing a spindle number into the storage means at a location associated with the spinning frame transporting the support means from the location associated with the spinning frame to the automatic winder, and writing data representing yarn characteristics into the storage means at a winding unit.

10. The method of claim 9, wherein the data representing yarn characteristics includes data representing at least on e of yarn breakage due to slub, yarn cutting due to a defect of a length not less than a preset length, evenness of the yarn, and yarn strength.

11. A spinning bobbin control apparatus for use with a spinning frame having a plurality of spindles and an automatic winder having a plurality of winding units, the spinning bobbin control apparatus comprising:

bobbin support means for supporting a spinning bobbin, storage means, disposed on the bobbin support means, for storing data, the storage means being capable of having the data written therein and read therefrom, first writing means, associated with the spinning frame, for writing a spindle number into the storage means, and second writing means, located at the automatic winder, for writing data representing yarn characteristics into the storage means.

12. A spinning bobbin control apparatus as claimed in claim 11, wherein the data representing yarn characteristics includes data representing at least one of yarn breakage due to slub, yarn cutting due to a defect of a length not less than a preset length, evenness of yarn, and a yarn strength.

13. A spinning bobbin control apparatus as claimed in claim 11, wherein the bobbin support means comprises a tray comprising a peg for fitting a bobbin upright thereon, a support portion for supporting a lower end of the bobbin, and a base to be placed on a conveyor.

14. A spinning bobbin control apparatus as claimed in claim 13, wherein the tray comprises an identification groove for the bobbin fitted upright thereon, provided for identification of bobbins at a branch point of passage on the conveyor.

15. A spinning bobbin control apparatus as claimed in claim 14, wherein the storage means comprises an annular identification card embedded in a portion of the base.

16. A spinning bobbin control apparatus as claimed in claim 14, wherein the storage means comprises a cylindrical identification card embedded in a portion of the base.

17. A spinning bobbin control apparatus as claimed in claim 14, wherein the storage means comprises an identification card embedded in a portion of an upper surface of the base.

18. A spinning bobbin control apparatus as claimed in claim 14, wherein the storage means comprises an identification card embedded in a lower face of the base.

19. A spinning frame as claimed in claim 11, wherein the second writing means comprises a plurality of writing devices, each writing device associated with a respective winding unit.

* * * * *